US005435834A

United States Patent [19]

Allen

[11] Patent Number: 5,435,834

[45] Date of Patent: Jul. 25, 1995

[54] ORE PELLETIZATION

[75] Inventor: Anthony P. Allen, West Yorkshire, England

[73] Assignee: Allied Colloids Limited, West Yorkshire, England

[21] Appl. No.: 190,115

[22] PCT Filed: Aug. 3, 1992

[86] PCT No.: PCT/GB92/01433

§ 371 Date: Feb. 2, 1994

§ 102(e) Date: Feb. 2, 1994

[87] PCT Pub. No.: WO93/03190

PCT Pub. Date: Feb. 18, 1993

[30] Foreign Application Priority Data

Aug. 2, 1991 [GB] United Kingdom ..... 9116700

[51] Int. Cl.[6] ..... C22B 1/244

[52] U.S. Cl. ..... 75/767; 75/321

[58] Field of Search ..... 75/767, 321

[56] References Cited

FOREIGN PATENT DOCUMENTS

| | | | |
|---|---|---|---|
| 890342 | 1/1972 | Canada . | |
| 195550 | 9/1986 | European Pat. Off. . | |
| 0225171 | 11/1986 | European Pat. Off. . | |
| 0288150 | 3/1988 | European Pat. Off. . | |
| 413603 | 2/1991 | European Pat. Off. . | |
| 9303189 | 2/1993 | WIPO | 75/767 |

*Primary Examiner*—Melvyn Andrews

*Attorney, Agent, or Firm*—Sughrue, Mion, Zinn, Macpeak & Seas

[57] ABSTRACT

Particulate ore is pelletized by forming an intimate mixture with particulate binder in the presence of moisture, forming green pellets by agitation of the mixture and then firing these to produce ore pellets and the particulate binder comprises particles of a water soluble, partly cross-linked, polymer formed from water soluble, ionic, ethylenically unsaturated monomer or monomer blend, wherein the extent of cross-linking is insufficient to render the particles predominantly water insoluble but is sufficient to increase the dry strength of the ore pellets.

16 Claims, No Drawings

ORE PELLETIZATION

This invention relates to ore pelletisation processes which comprise forming an intimate mixture of particulate ore and particulate binder in the presence of moisture, forming green pellets by agitation of the mixture (for instance by rolling or tumbling) and firing the green pellets to produce ore pellets.

Bentonite has been a widely used particulate binder but numerous proposals have been made to use synthetic or natural organic polymers.

In Canadian patent 890,342 it is proposed to include a water swellable polymer preferably having a gel capacity of at least 100, where the gel capacity is defined as the number of grams of water absorbed by one gram of polymer, the free water having been drained away by gravity. The inclusion of the particles is said to increase water tolerance and to give improved green strength, and an important advantage is said to arise when the initial ore is too wet. The polymers are described as lightly cross linked swellable polymers, with amounts of cross linking agent being from 50 to 10,000, preferably 500 to 7,000, ppm. Bentonite is used with the polymer as binder.

More usually, polymers used as binder for pelletisation processes are wholly water soluble. Thus the particulate binder may comprise synthetic polymer particles often having a size up to 300 μm formed by polymerisation of water soluble, ionic, ethylenically unsaturated monomer or monomer blend to form water soluble polymer particles. The monomer blend is free of cross linking agent, so as to avoid cross linking with the consequential risk of insolubility.

For example we describe in EP-A-225171 the use, as particulate binder, of water soluble synthetic polymer that has intrinsic viscosity 3 to 16 dl/g and that is an anionic polymer and we describe in EP 0288150 the use of cationic polymers. All the monomers described for use in the production of the soluble polymers are monoethylenically unsaturated and so the polymers are linear and are free of significant cross linking.

we mention in EP-A-225171 that the soluble polymer can be used in combination with a cross linked polymer that is cross linked with an amount of cross linking agent that is in the range 20 to 1000 ppm and that must be such that the particles are insoluble and have a gel capacity often above 50 g/g.

The amount of cross linking agent required to insolubilise a polymer will depend on the molecular weight of the polymer in the absence of the cross linking agent. Thus a very high molecular weight polymer may be totally insolubilised by the use of a very low amount of cross linking agent, but a relatively low molecular weight polymer may remain soluble even when a substantial amount of cross linking agent is used. Accordingly, in order to achieve the required insolubility at 20 ppm, as suggested in EP 225171, the polymerisation conditions must be such that, in the absence of the cross linking agent, a very high molecular weight polymer would be obtained.

The use as pelletisation binder of soluble anionic synthetic polymer has several advantages over the use of bentonite, but it can suffer from one disadvantage in that it is difficult to achieve adequate dry strength in the ore pellets at economic dosages. Even if the dosage is increased in order to improve dry strength, there may then be other disadvantages, such as stickiness and aggregation of pellets in the drum and instability during the pelletising process.

We now include, as particulate binder, synthetic polymer particles that comprise particles of a water soluble, partly cross linked polymer. As a result of using a partly cross linked polymer, in contrast to a polymer that is otherwise substantially identical but is substantially free of the deliberate partial cross linking, it is possible to achieve a significant increase in the dry strength of the ore pellets. However the benefit is only obtained over a relatively narrow range of partial cross linking and so the advantages of the invention are obtained when we select an amount of cross linking that is sufficient to increase the dry strength of the ore pellets but that is insufficient to render the polymer particles predominantly water-insoluble. Thus it is important in the invention that the particles should still behave predominantly as water soluble particles.

Whether or not particles behave predominantly as soluble or insoluble particles can be determined by gently stirring the particles into distilled water at 20° C. for up to thirty minutes and observing the nature of the solution. The concentration of the polymer in the solution will normally be chosen, for this observation, such that the solution is a viscous or slightly viscous flowable liquid. Generally therefore the concentration is not more than about 2% by weight, or 5% by weight maximum, and sometimes the concentration can be much less. A 1% concentration is typical.

When the particles are cross linked sufficient that they are predominantly water insoluble, they will behave in the 1% or other solution primarily as individual discrete particles, with little or no polymer in solution. For instance they retain their physical identity as particles within the solution, whereas the partly cross linked particles used in the invention should predominantly lose their physical identity in the solution. Thus the solution should appear substantially homogeneous and non-particulate.

One way of testing the suitability of the polymer is to cast a film from the solution. Provided the cross linking is sufficiently low to be suitable for use in the invention, it will be possible to obtain a reasonably uniform film having a thickness less, and often significantly less, than the average particle size since most of the particles will go into solution in preference to retaining their individual particulate shape. If the particles are too highly cross linked, the particles will retain their particulate shape and so the composition will either not form a film at all or will not form a reasonably uniform film having a thickness less than the average particle diameter. For instance film formation may be observed at increasing dilutions in order to determine the thickness at which the composition tends to lose its film forming capacity. If that occurs at a thickness of about the average particle size, this suggests that the particles are too strongly cross linked and insufficiently soluble.

One test we have adopted for determining suitable amounts of cross linking is a filtration test in which we measure the time it takes for a 0.5% aqueous solution obtained from a 70:30 blend of polymer and sodium carbonate particles in the size range 50 to 250 μm, often around 100 μm, to drain through a 150 μm sieve, when the polymer is a copolymer of 80% acrylamide and 20% sodium acrylate with IV around 7 to 9 dl/g. In this test, between 50 and 90% of the solution should drain through in 30 minutes for best performance. If less than 50% drains in 10 minutes the polymer is too cross linked and if substantially 100% drains in 3 minutes the polymer is insufficiently cross linked. With polymers that tend to be more viscous (e.g., higher IV) the times will need to be increased upwardly and with lower IV polymers the times will need to be adjusted downwardly.

At the desired low degree of cross linking, the solution will have a rheology that is still relatively "long" in the sense that if a glass rod is raised by hand slowly up from the solution it will pull a string of solution behind it for a length of at least 0.5 cm and usually at least 1 cm and frequently at least 2 cm. However the rheology must not be too long, since this would indicate inadequate cross linking. For instance if this string is as long as 10 cm, and sometimes as long as 5 cm, this may indicate inadequate cross linking.

Another way of ensuring that the cross linking is not too high is to determine the storage modulus G' and the loss modulus G", for instance using a Carri Med Rheometer in the oscillation mode using parallel plate geometry or, when the particles are sufficiently small, in the flow mode using cone and plate viscometry. In general, G' should have a value not more than about 1.5 or 2 times the value of G", and preferably not more than G". It is usually preferred for G' to be less than G", especially when the intrinsic viscosity of the corresponding linear polymer (see below) is reasonably low, e.g., up to about 7 or 8 dl/g. If G' greatly exceeds G", this indicates the polymer is tending to behave primarily as a cross linked particulate hydrogel (i.e., individual insoluble particles) rather than as a swollen network of soluble particles.

All these tests clearly distinguish between partly cross linked and predominantly water soluble and film forming particulate polymers, as required in the invention, and insoluble, non-film forming, high gel capacity particles that are unsuitable for use in the invention.

It is, however, sometimes unnecessary to determine the degree of cross linking by reference to rheology or solubility since in practice suitable amounts can be determined merely by testing the polymers in the intended ore pelletisation process, preferably using soft moisture (relatively free of divalent metal salts) or in combination with sodium carbonate (to precipitate divalent metal cations from the moisture). If a series of polymers are made under the same conditions from the same polymer blend and initiator system, but with differing amounts of cross linking agent, it will then be found that the dry strength gradually increases as the amount of added cross linker rises from zero to an optimum, and that any further increase in the amount of cross linking agent is liable to cause a sudden collapse in the dry strength. This probably corresponds to the amount of cross linker being sufficient to render the particles insoluble. Prior to that point, the polymer is sufficiently soluble to act as a good binder and the low amount of cross linking improves the binding performance.

The precise amount of cross linker will depend on the moisture, the ore, the type of cross-linker, the nature of the polymer, and, in particular, the IV (intrinsic viscosity) of the polymer in the absence of cross-linker.

In this specification, IV values are determined by conventional single point IV measurement in units of dl/g at 20° C.

The polymer is preferably a material made by polymerisation of the monoethylenically unsaturated monomer or monomer blend, substantially free of unwanted cross linking agent, in the presence of a controlled amount of added cross linking agent and under conditions such that, in the absence of added cross linking agent, the polymer would have single point IV up to about 16 dl/g. The IV is normally at least 2, and usually at least 3 dl/g so that a range of 3 to 15 dl/g is usually preferred.

When conducting a series of polymerisations at increasing amounts of cross linking agent, as described above it will be noticed that the single point IV often increases with additions of very small amounts of cross linker. This probably indicates that the cross linker is merely acting as a chain extender without making any noticeable difference to the solubility. Even at these very low levels of cross linking significant improvement in dry strength was obtained. Preferably the amount of cross linker is at least sufficient to give this increase in IV. As the amount of cross linking agent is increased, the solubility is adversely affected sufficient for IV measurement to become unreliable, but there is often a further increase in dry strength despite this drop in solubility. We observe that the drop number may start to deteriorate as soon as it no longer became possible to measure IV. It is preferred for the extent of cross linking to be such that the polymer still has a measurable single point IV and that this is higher than the IV of the linear polymer, or that the polymer should be cross linked a few ppm (for instance 5 to 10 ppm) beyond this point.

The cross linking agent can cause covalent or ionic cross linking through pendant groups, (e.g., by use of a glycidyl ether or multivalent metal salt) but preferably the cross linking agent is a diethylenically unsaturated monomeric cross linking agent. Methylene bis acrylamide is a suitable example but any of the conventional ethylenic cross linking agents can be used. The amount of added cross linking agent is generally in the range 2 to 100, usually 2 to 50 ppm and, as mentioned above, the amount of cross linking agent should be higher when the IV (of the linear polymer) is lower, and vice versa. When the IV is in the range 2 or 3 up to about 6 or 7 dl/g, the amount of cross linking agent is generally in the range 5 to 50 ppm, preferably around 7 to 20 ppm most preferably around 15 ppm. When the IV is higher, for instance above 7 and up to 16 dl/g, the amount of cross linking agent is generally in the range 2 to 30 ppm, preferably around 5 to 15 or 20 ppm, frequently at around 10 ppm. It is usually preferred for the amount of cross linker to be below 18 ppm, for instance 10–15 ppm and for the IV of the uncross linked polymer to be 5 to 9 dl/g. When the IV is low (e.g., below 3 dl/g) the amount of cross linker can be high (e.g., 50–100 or even 150 ppm MBA) without causing insolubility and these low IV, highly branched, soluble polymers can also be used in the invention.

The amount of cross linker mentioned in the preceding paragraphs is the amount by weight when the cross linking agent is methylene bis acrylamide (MBA). When other cross linking agents are used it is necessary to adjust the quoted amounts of cross linking agent (generally upwardly) in accordance with the ratio of the molecular weights per double bond between the different cross linker and MBA and in accordance with the cross linking reactivity of the cross linker so that the extent of cross linking (and therefore the solubility, rheology and performance) is substantially the same. For instance it may be necessary to use 10–20 parts triallylamine hydrochloride to obtain the same performance as 1 part MBA.

The particles of partly cross linked polymer can be introduced as a dispersion of the particles in oil, in which event the dispersion may have been made by reverse phase polymerisation of an aqueous monomer blend that includes the cross linking agent dispersed in a non-aqueous liquid, generally followed by distillation to produce a substantially anhydrous dispersion of the polymer particles in the non-aqueous liquid. Suitable lightly cross linked dispersions of this type are described in EP 0202780.

Another way of making substantially dry dispersions of polymer particles in oil is to disperse previously formed polymer powder into a non-aqueous liquid, for instance as described in EP 0277018.

It is generally preferred, however, for the polymer to be supplied as a dry, powdered, particulate composition. The composition may be in the form of particulate aggregates of small particles such that the aggregates break down into the individual small particles during the pelletisation process, for instance as described in EP 0326382. Often, however, it is convenient for the particles merely to be supplied in the form in which they are initially made. Thus the particles may have been made by gel polymerisation followed by comminution and drying, but preferably they are made by reverse phase bead polymerisation followed by drying and, if desired, comminution.

When the particulate polymer is introduced as a dispersion in oil, the particle size may be very small, for instance below 20 μm but usually the particle size is in the range 20 to 300 μm. Preferably the polymer particles are mainly below 200 μm, most preferably below 150 μm.

The polymer can be cationic, for instance as described in EP 0288150, but is generally anionic as in EP 225171. The amount by weight of sodium acrylate or other anionic monomer is generally in the range 5 to 90% by weight, with the balance preferably being acrylamide. It is normally preferred for the polymer to be a copolymer of acrylamide with 10 to 40%, often 15 to 30%, sodium acrylate, often with IV in the range 5 to 12. Preferably IV is from 5 to 9 and the amount of cross linker is 5 to 18 ppm, measured as MBA.

However it can be desirable to use larger amounts of sodium acrylate, e.g., 50 to 80%, typically around 70%. Increasing the amount of sodium acrylate in this manner may make it desirable to choose amounts of cross linking agent towards the upper end, or even slightly above, the ranges quoted above.

Generally the synthetic polymer particles in the particulate binder consist substantially only of the partly cross linked polymer particles described above. However the binder particles can include other binder components. For instance particulate binder can include particles of a natural binder, such as a water soluble cellulose (e.g., an ether such as hydroxyethyl cellulose or an ester such as carboxymethyl cellulose), a water soluble starch or a water soluble gum such as xanthan gum or, preferably, guar gum, and/or can contain bentonite. If additional binder such as bentonite or guar gum is to be included, the amount is often in the range 1 to 20 parts, preferably 5 to 15 parts, per part by weight of the lightly cross linked polymer. Preferably however that is the only binder used in the pelletising process but frequently it is used in admixture with various pelletising additives as described in EP 225171. The preferred additive is sodium carbonate.

If the moisture that is present in the pelletisation process is provided by softened water it is often preferred to use the polymeric binder in the absence of added inorganic electrolyte such as sodium carbonate because the presence of sodium carbonate under these circumstances can sometimes reduce the benefits of the cross linking effect. However in normal practice the moisture generally contains dissolved divalent metal salts, for instance as a result of being provided by relatively hard water, and under these circumstances it is desirable to include an inorganic electrolyte such as sodium carbonate since this promotes the desired improvement in dry strength, probably as a result of precipitating inorganic calcium salts and thus preventing the calcium insolubilising the polymer.

With the exception that the polymer will have been made in the presence of the defined small amount of cross linker, the materials used for making the polymer, the nature of the polymer, the amounts of polymer and moisture, and the pelletisation process conditions may all be as described in EP 225171. Generally the amount of the partly cross linked polymer is in the range 0.01 to 0.2%, usually 0.02 to 0.1%, by weight of the total mix and the amount of moisture is generally in the range 8 to 15% by weight.

Although the mineral ore is usually an iron ore, it can be any other particulate pelletisable mineral ore, such as a zinc ore. Its particle size is generally mainly below 250 μm.

The following are some examples.

EXAMPLE 1

A range of 20% sodium acrylate/80% acrylamide copolymers were prepared in the laboratory containing 0–250 ppm MBA (methylene bisacrylamide) as cross-linking agent.

| Product | ppm MBA | 1 pt IV/dlg-1 |
|---|---|---|
| A | 0 | 9.6 |
| B | 1 | 11.1 |
| C | 2.5 | 11.3 |
| D | 5 | — |
| E | 10 | — |
| F | 25 | — |
| G | 50 | — |
| H | 100 | — |
| I | 250 | — |

Particulate magnetite concentrate was then pelletised in conventional manner using 0.06% by weight of one of the polymers A to I as the binder and using softened water to provide the moisture. The results were as follows.

| | Green Strength/Kg | Dry Strength/Kg | Drop Number | % Moisture |
|---|---|---|---|---|
| A | 0.57 | 1.44 | 2.8 | 10.2 |
| B | 0.79 | 2.39 | 2.8 | 9.8 |
| C | 0.77 | 2.69 | 3.0 | 9.6 |
| D | 0.66 | 3.27 | 2.0 | 9.5 |
| E | 0.65 | 3.75 | 1.8 | 9.7 |
| F | 0.16 | 0.13 | 1.0 | 10.0 |
| G | 0.25 | 0.096 | 1.0 | 9.8 |
| H | 0.19 | 0.076 | 1.0 | 10.0 |
| I | 0.41 | 0.21 | 1.4 | 9.0 |

These results clearly demonstrate that increasing the amount of cross linking agent increases the dry strength up to a certain point after which the dry strength decreases dramatically. Also the drop number decreases at about the same point.

EXAMPLE 2

The process of Example 1 is repeated on an iron ore concentrate in which the moisture has not been softened, and thus is relatively hard. The following results are obtained.

| | Green Strength/Kg | Dry Strength/Kg | Drop Number | % Moisture |
|---|---|---|---|---|
| A | 1.07 | 2.30 | 11.0 | 8.7 |
| B | 1.28 | 2.02 | 25.4 | 9.7 |
| C | 0.87 | 1.88 | 20.2 | 9.0 |
| D | 1.14 | 1.93 | 28.2 | 9.6 |
| E | 0.92 | 1.40 | 17.3 | 8.8 |
| F | 0.40 | 0.31 | 2.0 | 7.4 |

This again shows that there is a marked deterioration when the amount of cross linking agent exceeds a value between 10 and 25 ppm MBA and that there is a beneficial effect on drop number at lower concentrations of MBA, but the results show that in this particular system the dry strength deteriorates with any cross linking, probably due to precipitation of the lightly cross linked polymer by calcium cations.

EXAMPLE 3

Example 2 was repeated except that 0.006% sodium carbonate was added to the polymer, to give a total binder content of 0.066%. The results were as follows.

| | Green Strength/Kg | Dry Strength/Kg | Drop Number | % Moisture |
|---|---|---|---|---|
| A | 0.77 | 1.42 | 28.3 | 9.4 |
| B | 0.77 | 1.15 | 19.4 | 9.5 |
| C | 0.76 | 1.63 | 18.6 | 9.4 |
| D | 0.94 | 2.54 | 32.0 | 9.8 |
| E | 0.85 | 2.63 | 19.6 | 9.7 |
| F | 0.28 | 0.19 | 1.8 | 7.9 |

This shows, as in Example 1, a significant increase in dry strength with increasing low amounts of MBA, followed by a sudden collapse in the dry strength and also, in this instance, the drop number.

I claim:

1. An ore pelletization process which comprises forming an intimate mixture of particulate ore and particulate binder in the presence of moisture, forming green pellets by agitation of the mixture and firing these to produce ore pellets, and in which the particulate binder comprises synthetic polymer particles, wherein the synthetic polymer particles consist essentially of powder particles which have a size of 20 to 300 μm and which have been formed by polymerization of a water soluble ionic ethylenically unsaturated monomer or monomer blend including added cross-linking agent, and which have a solubility in water such that a solution of the particles in water can be cast to form a substantially uniform film having a thickness less than the average particle diameter.

2. A process according to claim 1, in which the polymer has been made by polymerization of the monomer or monomer blend in the presence of at least 2 ppm ethylenic cross-linking agent under conditions such that, in the absence of the added cross-linking agent, the polymer would have single point IV of 2 to 16 dl/g.

3. A process according to any of claims 2 to 4 in which the amount of cross linking agent is below 18 ppm.

4. A process according to claim 1, in which the extent of cross-linking is such that the dry strength of the ore pellets is higher than when the corresponding polymer is not cross linked.

5. A process according to claim 1, in which the synthetic polymer particles are formed of a blend of 10 to 90% acrylamide and 90 to 10% sodium acrylate,

6. A process according to claim 1, in which the synthetic polymer particles are formed of a blend of 60 to 90% by weight acrylamide and 40 to 10% by weight sodium acrylate and have IV 5 to 9 dl/g,

7. A process according to claim 1, in which the ore is iron ore in the form of particles mainly below 250 μm,

8. An ore pelletization process which comprises forming an intimate mixture of particulate ore and particulate binder in the presence of moisture, forming green pellets by agitation of the mixture and firing these to produce ore pellets, and in which the particulate binder comprises synthetic polymer wherein the synthetic polymer consists essentially of powder particles which have a size of 20 to 300 μm and which have been formed by polymerization of water soluble ionic ethylenically unsaturated monomer or monomer blend in the presence of at least 2 ppm of added ethylenic cross-linking agent under conditions such that, in the absence of the added cross-linking agent, the polymer would have a single point IV of 2 to 16 dl/g, and wherein the amount of the added cross-linking agent is in the range of 5 to 50 ppm when said IV is up to 7 dl/g and the amount of the added cross-linking agent is in the range of 2 to 30 ppm when said IV is above 7 dl/g.

9. A process according to claim 8, in which the amount of cross-linking agent is below 18 ppm.

10. A process according to claim 8, in which the extent of cross-linking is such that the dry strength of the ore pellets is higher than when the corresponding polymer is not cross-linked.

11. A process according to claim 8, in which the synthetic polymer particles are formed of a blend of 10 to 90% acrylamide and 90 to 10% sodium acrylate.

12. A process according to claim 8, in which the synthetic polymer particles are formed of a blend of 60 to 90% by weight acrylamide and 40 to 10% by weight sodium acrylate and have IV 5 to 9 dl/g.

13. A process according to claim 8, in which the ore is iron ore in the form of particles mainly below 250 μm.

14. A process according to claim 8 in which the amount of cross-linking agent is 7 to 20 ppm when the said IV is 3 up to 7 dl/g and 5 to 15 ppm when the said IV is above 7 up to 16 dl/g.

15. An ore pelletization process which comprises forming an intimate mixture of particulate ore and particulate binder in the presence of softened water, the mixture being free of added inorganic electrolyte, forming green pellets by agitation of the mixture and firing these to produce ore pellets, and in which the particulate binder comprises synthetic polymer particles having a size of up to 300 μm formed by polymerization of a water soluble ionic, ethylenically unsaturated, monomer or monomer blend, characterized in that the synthetic polymer particles comprise particles of a water soluble polymer which has been made by polymerization of the monomer or monomer blend in the presence of at least 2 ppm ethylenic cross-linking agent under conditions such that in the absence of the cross-linking agent the polymer would have a single point IV of 2 to 16 dl/g and wherein the extent of cross-linking of the polymer is insufficient to render the polymer particles predominantly water insoluble.

16. An ore pelletization process which comprises forming an intimate mixture of particulate ore and particulate binder in the presence of hard water, the mixture including added inorganic electrolyte that will precipitate calcium salts, forming green pellets by agitation of the mixture and firing these to produce ore pellets, and in which the particulate binder comprises synthetic polymer particles having a size of up to 300 μm formed by polymerization of a water soluble ionic, ethylenically unsaturated, monomer or monomer blend, characterized in that the synthetic polymer particles comprise particles of a water soluble polymer which has been made by polymerization of the monomer or monomer blend in the presence of at least 2 ppm ethylenic cross-linking agent under conditions such that in the absence of the cross-linking agent the polymer would have a single point IV of 2 to 16 dl/g and wherein the extent of cross-linking of the polymer is insufficient to render the polymer particles predominantly water insoluble.

* * * * *